US007433274B1

(12) United States Patent
Bath

(10) Patent No.: US 7,433,274 B1
(45) Date of Patent: Oct. 7, 2008

(54) RAPID SET HANDICAPPED ALARM CLOCK

(76) Inventor: Eugene R. Bath, 2050 Cornerstone Dr., Colorado Springs, CO (US) 80918

( * ) Notice: Subject to any disclaimer, the term of this patent is extended or adjusted under 35 U.S.C. 154(b) by 0 days.

(21) Appl. No.: 11/601,871

(22) Filed: Nov. 20, 2006

(51) Int. Cl.
*G04B 23/02* (2006.01)

(52) U.S. Cl. ..... 368/73

(58) Field of Classification Search ..... 368/73
See application file for complete search history.

(56) References Cited

U.S. PATENT DOCUMENTS

| | | | | |
|---|---|---|---|---|
| 4,456,385 | A * | 6/1984 | Hattori | 368/187 |
| 4,582,434 | A * | 4/1986 | Plangger et al. | 368/46 |
| 4,769,796 | A * | 9/1988 | Levine | 368/29 |
| 5,487,053 | A * | 1/1996 | Beiswenger et al. | 368/69 |
| 5,619,477 | A * | 4/1997 | Schenk | 368/10 |
| 5,701,678 | A * | 12/1997 | Wang | 33/268 |
| 6,259,655 | B1 * | 7/2001 | Witort | 368/28 |
| 6,888,779 | B2 * | 5/2005 | Mollicone et al. | 368/10 |
| 6,967,900 | B2 * | 11/2005 | Chapman | 368/10 |
| 2003/0198137 | A1 * | 10/2003 | Gorden | 368/12 |
| 2005/0169110 | A1 * | 8/2005 | Mazzilli et al. | 368/73 |
| 2006/0133215 | A1 * | 6/2006 | Gordon et al. | 368/79 |

* cited by examiner

*Primary Examiner*—Edwin A. Leon
*Assistant Examiner*—Thanh S Phan
(74) *Attorney, Agent, or Firm*—G. F. Gallinger

(57) ABSTRACT

An easily set alarm clock which provides continuous and reliable assurance of correct alarm activation. The alarm clock comprises: a) an upright display screen having a large 4 digit time display portion and a smaller 4 digit alarm display portion; b) a lateral keypad positioned beneath the display screen, said keypad having time set function keys positioned in vertical alignment along a left side portion of the keypad, a numeric key portion positioned immediately to the right of the time set function keys on a central portion of the keypad for entry of the time corresponding to the selected function key, and AM/set-PM/set selection keys positioned in vertical alignment along a right side portion of the keypad. The clock configured so that if an alarm time is displayed the alarm is ON and will always activate audibly at the alarm time displayed, and alternatively if a time is not displayed the alarm is OFF. After a user has easily and quickly set both the clock and alarm time by pressing keys from left to right on the key pad, he can then, at any time be assured that the alarm will invariably sound at that alarm time displayed. The alarm is so easily set that a handicapped individual, without holding the alarm clock, can entirely make all settings from a front side portion of the clock with a stick held in his mouth, one key at a time.

18 Claims, 1 Drawing Sheet

RAPID SET HANDICAPPED ALARM CLOCK

FIELD OF THE INVENTION

This invention relates to user friendly, and reliable alarm clocks. More particularly this invention relates to an alarm clock which prompts successively for, and thereafter continuously displays all entered data so that set up is efficient, rapid, and assured. Setup is so easy that a handicapped individual can enter all information with a mouth held stick, without holding the alarm clock.

BACKGROUND OF THE INVENTION

Digital alarm clocks are unnecessarily complicated in their set up. All too many individuals have missed important appointments when the alarm they thought they had correctly set up, did not awaken them. The volume may have been turned off. The switch may have been in the wrong position. Either the clock or the alarm time may not have been set for the time of day. Either the clock or the alarm time may have been inadvertantly set for PM when AM was intended. Setting the alarm prior to an important appointment is a procedure that must be undertaken, reconsidered, and then rechecked.

Many individuals do not regularly use an alarm. Many individuals have not adjusted their alarm for many months. Only occasionally when they must arise earlier do they need to adjust and rely on an alarm clock. They may not fully recollect how to ensure that the alarm clock rings for their early schedule. What is needed is an alarm clock with an intuitive keypad setup. An alarm clock which initially prompts and subsequently confirms entered information so that any time during or after information entry, the individual can simply glance at the face of the clock and confirm that what he intends is entered into the clock. It is also useful to have an lighted prompts which flash until each necessary selection is made. It is not unusual for an individual on a business trip to have a poor night's sleep prior to an important appointment. His body clock may have been thrown off and he cannot help waking up well in advance of his important appointment to ensure he arrives in a timely fashion. Hotels spend considerable time and energy on wake up calls. The desk clerks don't usually call at precise times. They don't even always call. What is needed is a failsafe alarm clock. A clock which is virtually foolproof in its setup, and a clock which visibly assures a conscientious individual that they will reliably be awakened.

Alarm clocks typically require two hands for set-up and the procedure is relatively complicated, frequently frustrating, and compatatively time consuming. They are neither intuitive or user friendly and preclude use by many handicapped individuals unable to access and manipulate multiple buttons and switches. A clock in which all data can be entered wholly through a readily accessible keypad not only facilitates use by handicapped individuals who otherwise would be unable to independently operate an alarm clock, but additionally facilitates rapid data entry by other individuals. Existing alarm clocks do not concurrently display more than one time parameter so that a user is forced to activate buttons or switches to view any programmed alarm time. What also is needed is an alarm clock that would continuously and concurrently show, at a glance, the time of day and all activated alarm times.

OBJECTS OF THE INVENTION

It is an object of this invention to disclose an alarm clock which is easy to set up. It is an object of this invention to disclose an alarm clock which is difficult to set up improperly. It is an object of this invention to disclose an alarm clock wherewith one intuitively enters information from left to right of a keypad and wherein flashing prompts persist until a final AM/PM selection is made. It is an object of this invention to disclose an alarm clock for the handicapped which can be set up, without holding the clock, from a front side of the clock with a stick held in one's mouth. It is yet a further object of this invention to disclose an alarm clock which prompts a user to enter all data required thereby ensuring that all data is entered correctly. It is an object of this invention to disclose an alarm clock which continuously displays all active parameters and which is configured to only and always activate audibly an alarm when the alarm is displayed, so that a user is continuously assured that he will be awakened when the alarm display is displayed. It is yet a further object of this invention to provide the best possible assurance of alarm activation at the time displayed. In the disclosed clock not only is a low battery indicator comprises both a flashing lamp and a redundant audible alarm. It is a final object of this invention to promote better sleep for those who have an important early appointment to attend.

One aspect of this invention provides for an easily set alarm clock which provides continuous and reliable assurance of correct alarm activation. The alarm clock comprises: a) an upright display screen having a large 4 digit time display portion and a smaller 4 digit alarm display portion; b) a lateral keypad positioned beneath the display screen, said keypad having time set function keys positioned in vertical alignment along a left side portion of the keypad, a numeric key portion positioned immediately to the right of the time set function keys on a central portion of the keypad for entry of the time corresponding to the selected function key, and AM/set-PM/set selection keys positioned in vertical alignment along a right side portion of the keypad; The clock configured so that if an alarm time is displayed the alarm is ON and will always audibly activate at the alarm time displayed, and alternatively if a time is not displayed the alarm is OFF. After a user has easily and quickly set both the clock and alarm time by pressing keys from left to right on the key pad, he can then, at any time be assured that the alarm will invariably sound at that alarm time displayed.

In a preferred aspect of this invention the clock is configured to flash the display portion designated by the pressed time set function key a) initially confirming to the user that said display portion has been selected for data entry, said display portion varying in intensity until data is entered and displayed, and then, b) again varying the intensity of the corresponding AM/PM light of the display screen until such designation is made by the user.

In yet another aspect of this invention the clock is so easily set that a handicapped individual, without holding the alarm clock, can entirely make all settings from a front side portion of the clock with a stick held in his mouth.

Various other objects, advantages and features of this invention will become apparent to those skilled in the art from the following description in conjunction with the accompanying drawings.

FIGURES OF THE INVENTION

Figure 1:
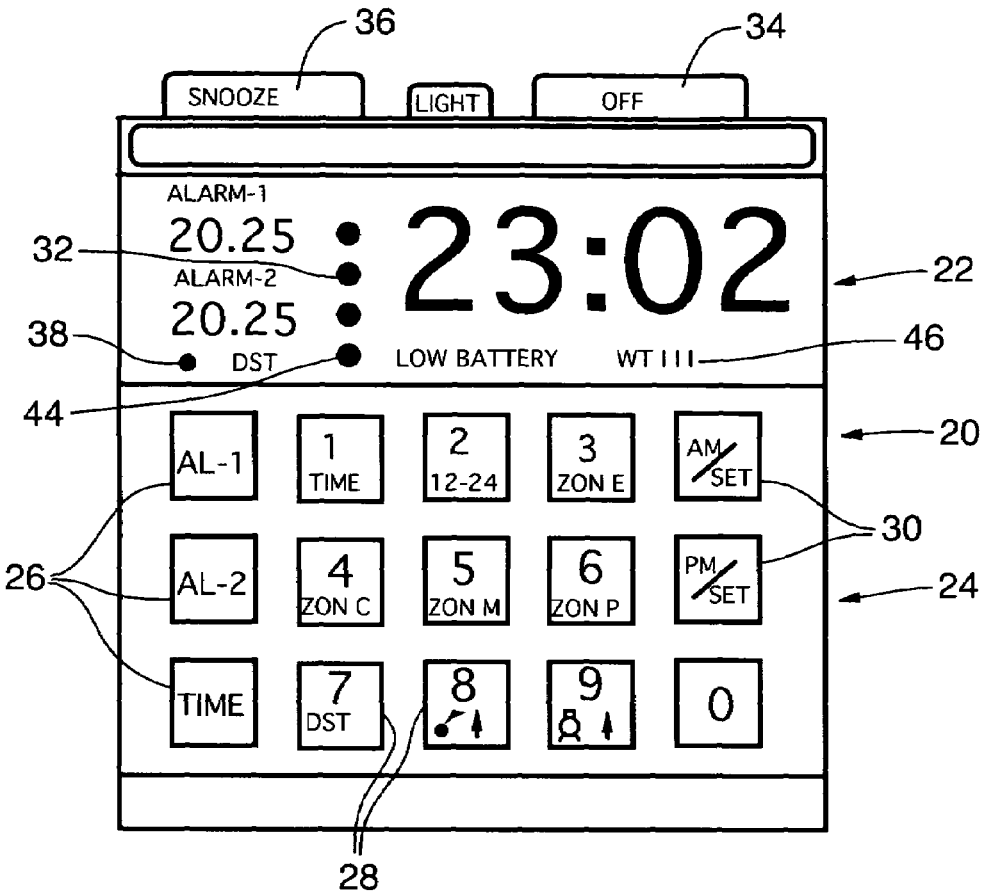
FIG. 1 is a front view of a rapid set alarm clock.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
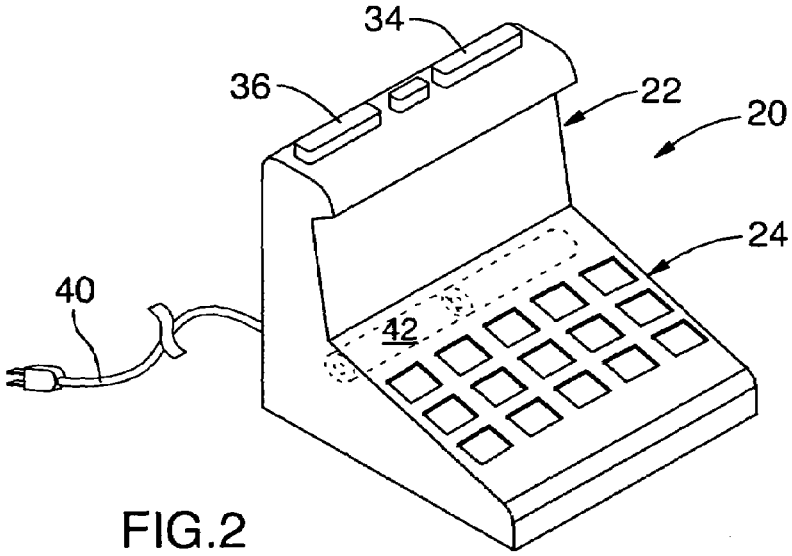
FIG. 2 is a perspective view of the alarm clock shown in FIG. 1.

Turning now to the drawings and more particularly to FIGS. 1 and 2 we have a front and perspective view of a failsafe easy set alarm clock 20. Most generally easily set alarm clock 20 which provides continuous and reliable assurance of correct alarm activation comprises: a) an upright display screen 22 having a large 4 digit time display portion and a smaller 4 digit alarm display portion; b) a lateral keypad 24 positioned beneath the display screen 22, said keypad 24 having time set function keys 26 positioned in vertical alignment along a left side portion of the keypad 24, a numeric key 28 portion positioned immediately to the right of the time set function keys 26 (FIG. 1 shows three time set function keys: time, alarm 1, and alarm 2) on a central portion of the keypad 24 for entry of the time corresponding to the selected function key 26, and AM/set-PM/set selection keys 30 positioned in vertical alignment along a right side portion of the keypad 24. The clock 20 is configured so that if an alarm time is displayed the alarm is ON and will always activate audibly at the alarm time displayed; and alternatively, if a time is not displayed the alarm is OFF. After a user has easily and quickly set both the clock and alarm time by pressing keys from left to right on the key pad 24, he can then, at any time be assured that the alarm will invariably sound at that alarm time displayed.

Most preferably the display screen 22 provides for two smaller 4 digit alarm display portions. When there are two alarm display portions there are two alarm set function keys 30 so that the clock can be set for two different times. In FIG. 2 the keypad 24 is beneath and in front of the display screen 22. Most preferably the clock is configured to vary the intensity of the display portion designated by the pressed time set function key a) initially confirming to the user that said display portion has been selected for data entry, said display portion varying in intensity until data is entered and displayed, b) varying the intensity of a corresponding AM/PM display portion of the screen 22 until such selection is made by the user. In the most preferred embodiment of the invention the keypad has less than a 30 degree slope, so that a handicapped individual may enter all information from a front side portion of the alarm clock 20, without the need to hold the alarm clock 20, and with a mouth held stick which is used to downwardly depress keys on the keypad 24.

In one embodiment of the invention the alarm clock 20 has a display light 32 which designates AM and PM. In a preferred embodiment the AM/PM display light 32 flashes subsequent to time entry and prior to AM/PM designation so that the user is prompted to make the selection. The user thereby can be more assured that his selection is properly entered when the display is solidly lit. It is noted that to cover a three digit time entry, for example 3:04, that the AM/PM indicator light would have to begin flashing after entry of three digits even if four digits were to be entered.

Most preferably the variation in light intensity comprises the display portion flashing on and off. In the most preferred embodiment of the invention the flashing continues for up to 5 seconds, and if an additional entry is not made within that period, the clock and display portion revert back. Most preferably, the alarm 20 can be disabled by pressing said time set function key 26 for the alarm and then within the period of varying light intensity, by pressing the OFF key 34—whereupon the alarm time in the alarm display portion will disappear. Most preferably either alarm can be reactivated by repressing the time set function key 26 for the alarm—whereupon the prior time in the alarm display portion will reappear. In the most preferred embodiment of the invention the alarm clock 20 further comprises a snooze key 36. Upon an alarm sounding each press of the snooze key 36 will further delay alarm sounding a small block of time up to 60 minutes.

The alarm clock 20 most preferably includes the following features: a) pressing and holding a designated numeric key 28 toggles the clock operation between a 12 hour and a 24 hour clock mode; b) pressing and holding a designated numeric key 28 toggles the display portion to a brighter/dimmer display portion; c) pressing and holding a designated numeric key 28 toggles the loudness of the alarm clock 20 sound as indicated by an audible alarm tone; d) pressing and holding a designated numeric key 28 toggles the clock 20 to switch to and from daylight savings time and wherein a screen display indicates such daylight savings time switching is enabled. When the alarm clock 20 is powered by a 120 volt power supply 40 a battery backup 42 is provided for power interruption, and a low battery power flashing visual indicator 44 and a redundant audible alarm so that attention is drawn to the low battery light by the audible alarm. It is contemplated that particularly in a hotel environment house keeping staff who would not note a flashing lamp on the face of a clock would note an audible low battery alarm.

In another aspect of the invention the alarm clock 20 is of the type which will automatically set itself with the World Time Clock (not shown). The World Time Clock broadcasts a radio signal accurately defining the correct time from the State of Colorado. Pressing and holding one of several designated keys will configure the clock 20 to a selected Time Zone. The selected Time Zone is indicated by an immediate switch of the time displayed on the clock 20 to the correct time in the selected time zone. A moving bar 46 on the display portion 22 indicates the clock 20 is receiving a World Time signal.

A quick and reliable general method of time entry providing continuous confirmation of both alarm clock 20 operation and alarm activation comprises the steps of: a) providing an alarm clock 20 as specified in claim 3; b) selecting and then pressing one of a plurality of time set function keys 26, thereby causing a digital display portion corresponding to the selected function key 26 to flash, confirming to the user that said function has been selected for information entry; c) pressing keys 28 on a numeric keypad positioned immediately to the right of the set function keys 26 to enter a numeric value corresponding to the desired times, whereupon said entry discontinues the flashing of the selected display portion on the display screen, and whereupon said numeric digits are displayed in the selected function display portion as entered; and thereafter, d) pressing one of an AM/set and a PM/set selection key, said keys 30 positioned in vertical alignment along a right side portion of the keypad, and wherein prior to pressing said AM/set-PM/set key 30 a flashing AM/PM indicator light 32 prompts the user to make an AM/PM selection, and whereafter said selection is made the flashing light 32 is discontinued. A user is guided to fully enter all data for each of the time set functions by using first the left, then the central, and finally the right portion of the keypad 24. The designated display portion of each flash until, and only until, information data therein is entered. Thereafter the user can be assured, by viewing the selected times continuously displayed, that the alarm clock is correctly and most assuedly activated. This general method can be further specified by including the alarm clock 20 limitations of claims 5, 6, 7, or 14 in the general method.

While the invention has been described with preferred specific embodiments thereof, it will be understood that this description is intended to illustrate and not to limit the scope of the invention, which is defined by the following claims.

I claim:

1. An easily set alarm clock which provides continuous and reliable assurance of correct alarm activation comprises:

a) an upright front display screen having a large 4 digit time display portion and a smaller 4 digit alarm display portion;

b) a lateral keypad positioned beneath the display screen, said keypad having time set function keys positioned in vertical alignment along a left side portion of the keypad, a numeric key portion positioned immediately to the right of the time set function keys on a central portion of the keypad for entry of the time corresponding to the selected function key, and AM/set-PM/set selection keys positioned in vertical alignment along a right side portion of the keypad;

c) said clock configured so that if an alarm time is displayed the alarm is ON and will always activate audibly at the alarm time displayed, and alternatively if a time is not displayed the alarm is OFF;

d) said clock also configured so that the display portion corresponding to each of the portions of the keyboard flash until, and only until, all data is fully entered for a selected function;

so that after a user has easily and quickly set both the clock and alarm time by pressing keys from left to right on the key pad, he then at any time view and be assured that all data is fully entered and the clock will invariably sound at that alarm time displayed.

2. An alarm clock as in claim 1 wherein the display screen provides for two smaller 4 digit alarm display portions and where there are two alarm set function keys so that the alarm can be set for two different times, and wherein the keypad is beneath and in front of the display screen.

3. An alarm clock as in claim 1 wherein the keypad is generally horizontal, so that a handicapped individual may enter all information from a front side portion of the alarm clock, without the need to hold the alarm clock, and with a mouth held stick which is used to downwardly depress keys on the keypad, one key at a time.

4. An alarm clock as in claim 1 wherein the flashing continues for up to 5 seconds, and if an additional entry is not made within that period, the clock and display revert back.

5. An alarm clock as in claim 4 wherein an active alarm can be deactivated by pressing said corresponding time set function key for the alarm, and then within the period of varying light intensity, by pressing the OFF key—whereupon the alarm time in the alarm display portion will disappear.

6. An alarm clock as in claim 5 wherein either alarm can be reactivated by pressing the corresponding one of the time set function keys—whereupon the prior time in the alarm display portion will reappear.

7. An alarm clock as in claim 1 wherein the clock is powered by a 120 volt power supply, having a battery backup for power interruption, and having a low battery flashing visual indicator and a redundant audible alarm so that attention is drawn to the battery light by the audible alarm.

8. An alarm clock as in claim 1 wherein the clock will automatically set itself with the World Time Clock and wherein pressing and holding one of several designated keys will configure the clock to a selected Time Zone, and wherein the selected Time Zone is indicated by an immediate switch of the time shown on the display portion of the clock to the correct time in the selected time zone.

9. An alarm clock as in claim 8 wherein a moving bar on the display portion indicates the clock is receiving a World Time signal.

10. A clock as in claim 1 wherein said clock is configured so that if an alarm time is displayed the alarm is ON and will always activate audibly at the alarm time displayed, and alternatively if an alarm time is not displayed the alarm is OFF; so that a user can be assured that the clock will invariably sound at that alarm time displayed.

11. A clock as in claim 10 wherein the select/set function keys are on a left portion of the keypad, the set time keys are on a central portion of the keypad, and wherein the keypad further comprises AM/set-PM/set selection keys positioned in vertical alignment along a right side portion of the keypad; so that the user is prompted to enter and continue entering data beginning on the left and finishing on the right side of the keypad for each chosen function.

12. A quick and reliable method of time entry providing continuous confirmation of both alarm clock operation and alarm activation comprising the steps of:

a) obtaining an alarm clock having i) an upright front display screen having a large 4 digit time display portion and a smaller 4 digit alarm display portion; ii) a lateral keypad positioned beneath the display screen, said keypad having time set function keys positioned in vertical alignment along a left side portion of the keypad, a numeric key portion positioned immediately to the right of the time set function keys on a central portion of the keypad for entry of the time corresponding to the selected function key, and, iii) AM/set-PM/set selection keys positioned in vertical alignment along a right side portion of the keypad;

c) said clock configured so that if an alarm time is displayed the alarm is ON and will always activate audibly at the alarm time displayed, and alternatively if a time is not displayed the alarm is OFF;

b) selecting and then pressing one of a plurality of time set function keys, thereby causing a display portion corresponding to the selected function key to flash, and confirming to the user that said function has been selected for data entry;

c) pressing keys on the keypad positioned immediately to the right of the set function keys to enter a numeric value corresponding to the desired time, whereupon said entry discontinues the flashing of the selected display portion, and whereupon said numeric digits are displayed in the selected display portion as entered; and thereafter, d) pressing one of an AM/set and a PM/set selection key, said keys positioned in vertical alignment along a right side portion of the keypad, and wherein prior to pressing said AM/set-PM/set key a flashing AM/PM indicator light prompts the user to make an AM PM selection, and whereafter said selection is made the flashing is discontinued;

so that a user is prompted to fully enter all data for each of the time set functions by using first the left, then the central, and finally the right portion of the keypad, and wherein the display portion corresponding to each of the portions of the keyboard flash until, and only until, all data is fully entered;

so thereafter the user can be assured, by viewing the selected times continuously displayed, that the alarm clock is correctly and most assuredly activated.

13. A method as in claim 12 wherein the flashing continues for up to 5 seconds, and if an additional entry is not made in that period, the clock and display revert back.

14. A method as in claim 13 wherein an alarm can be deactivated by pressing said alarm function key and then within the period of flashing, by pressing the OFF key—whereupon the alarm time in the display portion will deactivate and disappear.

15. A method as in claim 14 wherein either alarm can be re-activated by pressing one of the alarm function keys—whereupon the prior time in the alarm display portion will reappear.

16. An easily set alarm clock which provides continuous and reliable assurance of correct alarm activation comprises:

a) an upright front display screen having a large 4 digit time display portion and a smaller 4 digit alarm display portion;

b) a keypad having i) time/alarm select function keys, and ii) a key portion for entry of the time corresponding to the selected function key;

c) said clock configured so that the display portion corresponding to each of the portions of the keyboard flash until, and only until, all data is fully entered for a chosen function;

so that a user cannot inadvertently enter only partial insufficient information; and, so that after a user has set both the clock and alarm time he then at any time can view and be assured that all data is fully entered.

17. A quick and reliable method of time entry providing continuous confirmation of both alarm clock operation and alarm activation comprising the steps of:

a) obtaining an alarm clock as specified in claim 16;

b) selecting and then pressing one of a plurality of time set function keys, thereby causing a display portion corresponding to the selected function key to flash, and confirming to the user that said function has been selected for data entry;

c) pressing keys on the keypad to enter a numeric value corresponding to the desired time, whereupon said entry discontinues the flashing of the selected display portion, and whereupon said numeric digits are displayed in the selected display portion as entered; and thereafter, so that a user is prompted to fully enter all data for each of the time set functions, and wherein the display portion corresponding to each of the portions of the keyboard flash until, and only until, all data is fully entered;

so thereafter the user can be assured, by viewing the selected times continuously displayed, that the alarm clock is correctly and most assuredly activated.

18. A method as in claim 17 wherein the keypad includes an AM/set-PM/set selection key and wherein the method further comprises the step of pressing said key to designate either AM or PM.

* * * * *